US011064766B2

(12) United States Patent
Kfir

(10) Patent No.: US 11,064,766 B2
(45) Date of Patent: Jul. 20, 2021

(54) INSOLE WITH CUSTOMIZABLE RESILIENT FOREFOOT SECTIONS AND/OR SUBSECTIONS

(71) Applicant: TK IN SO LES LTD., Savyon (IL)

(72) Inventor: Tamir Kfir, Mazor (IL)

(73) Assignee: TK IN SO LES LTD., Savyon (IL)

( * ) Notice: Subject to any disclaimer, the term of this patent is extended or adjusted under 35 U.S.C. 154(b) by 54 days.

(21) Appl. No.: 16/194,348

(22) Filed: Nov. 18, 2018

(65) Prior Publication Data

US 2020/0154827 A1 May 21, 2020

(51) Int. Cl.
*A43B 17/02* (2006.01)
*A43B 17/14* (2006.01)
*A43B 7/14* (2006.01)

(52) U.S. Cl.
CPC ..... *A43B 17/02* (2013.01); *A43B 7/142* (2013.01); *A43B 7/143* (2013.01); *A43B 7/144* (2013.01); *A43B 7/1425* (2013.01); *A43B 7/1435* (2013.01); *A43B 7/1445* (2013.01); *A43B 7/1465* (2013.01); *A43B 17/14* (2013.01)

(58) Field of Classification Search
None
See application file for complete search history.

(56) References Cited

U.S. PATENT DOCUMENTS 3,624,930 A * 12/1971 Johnson ..... A43B 17/08 36/43
4,841,648 A * 6/1989 Shaffer ..... A43B 7/1465 36/145
5,438,768 A * 8/1995 Bauerfeind ..... A43B 7/1425 36/165
5,787,608 A * 8/1998 Greenawalt ..... A43B 3/128 36/11.5
6,070,342 A * 6/2000 Brown ..... A43B 7/142 36/44
7,484,319 B2 * 2/2009 Cheskin ..... A43B 7/141 36/144
8,453,346 B2 * 6/2013 Steszyn ..... A43B 7/142 36/146
2006/0123663 A1 * 6/2006 Swensen ..... A43B 7/1465 36/43
2007/0079532 A1 * 4/2007 Ramirez ..... A43B 7/1415 36/140

(Continued)

*Primary Examiner* — Ted Kavanaugh
(74) *Attorney, Agent, or Firm* — Mark M. Friedman

(57) ABSTRACT

A removable insole for insertion into footwear, comprises a forefoot portion integral to the insole and extending at least to a metatarsal of a foot and including a resilient layer, the resilient layer including at least two non-contiguous resilient layer sections (including a big toe section). The at least two non-contiguous resilient sections include at least four resilient layer subsections in some embodiments, a continuous rear portion that includes a medial longitudinal arch support portion, a heel surrounding portion and a lateral longitudinal arch support portion; and a heel portion. In some embodiments, the forefoot is customizable by having different levels of hardness for the subsections and big toe section. The insole is therefore tailored a particular sport. The medial longitudinal arch support portion includes a detachable cushion configured to adjust a height of the medial longitudinal arch and to support the foot during pronation of the foot.

14 Claims, 6 Drawing Sheets

(56) References Cited

U.S. PATENT DOCUMENTS

| | | | | |
|---|---|---|---|---|
| 2010/0205831 | A1* | 8/2010 | Cheskin | A43B 13/386 36/44 |
| 2011/0041360 | A1* | 2/2011 | Torrance | A43B 7/142 36/91 |
| 2016/0219970 | A1* | 8/2016 | Jacob | A43B 17/006 |
| 2018/0008002 | A1* | 1/2018 | Yick | A43B 7/1425 |

* cited by examiner

INSOLE WITH CUSTOMIZABLE RESILIENT FOREFOOT SECTIONS AND/OR SUBSECTIONS

FIELD AND BACKGROUND OF THE INVENTION

The invention is in the field of insoles and more particularly, to an insole configured to be tailored to different users and/or different sports.

SUMMARY OF THE INVENTION

One aspect of the invention is a removable insole for insertion into footwear, comprising a forefoot portion integral to the insole and extending at least to a metatarsal of a foot and including a resilient layer, the resilient layer including at least two non-contiguous resilient layer sections, the at least two non-contiguous resilient sections including four resilient layer subsections, a continuous rear portion that includes a medial longitudinal arch support portion, a heel surrounding portion and a lateral longitudinal arch support portion; and a heel portion.

In some embodiments, the at least two non-contiguous resilient layer sections comprise three non-contiguous resilient layer sections. In some embodiments, one of the three non-contiguous resilient layer sections comprises the four resilient layer subsections.

In some embodiments, one of the at least two non-contiguous resilient layer sections corresponds to a portion of the insole supporting a phalanx of a big toe of the foot and is comprised of a first material and the at least four resilient layer subsections are comprised of the first material.

In some embodiments, one of the at least four resilient layer subsections within a particular non-contiguous resilient layer section comprises a first level of hardness and another one of the at least four resilient layer subsections within the particular non-contiguous resilient layer section comprises a second level of hardness that is softer than the first level of hardness.

In some embodiments, at least two of four resilient layer subsections within a particular non-contiguous resilient layer section have different levels of hardness.

In some embodiments, each resilient layer subsection of the at least two non-contiguous resilient layer sections has a hardness level that is selected independently so as to tailor the forefoot to a particular sport to be played by a wearer of the footwear.

In some embodiments, each resilient layer subsection of a particular non-contiguous resilient layer section and two resilient layer sections other than the particular resilient layer section has a hardness level that is selected independently. In some embodiments, of the following six portions of the forefoot: the four resilient layer subsections and the two resilient layer sections other than the particular resilient layer, five of the six portions of the forefoot have a first hardness level and a sixth has a second hardness level that is softer than the first hardness level.

In some embodiments, the insole further comprises a detachable metatarsal cushion configured to support an anterior transverse arch of a wearer's foot and to redistribute pressure on at least one of a forefoot and mid-foot area of the foot. In some embodiments, the metatarsal cushion is harder than the resilient layer subsections.

In some embodiments, the medial longitudinal arch support portion includes an integral resilient layer and a detachable cushion, the detachable cushion configured to adjust a height of a medial longitudinal arch of the foot and to support the foot during pronation.

In some embodiments, the lateral longitudinal arch support portion includes a detachable cushion configured to support the lateral longitudinal arch of the foot and to redistribute pressure to avoid hairline and fifth metatarsal fractures.

A further aspect of the invention is a removable insole for insertion into footwear, comprising a forefoot portion integral to the insole and extending at least to a metatarsal of a foot and including a resilient layer, the resilient layer including at least two non-contiguous resilient layer sections, one of the at least two non-contiguous resilient sections including four separate non-contiguous resilient layer subsections, a continuous rear portion that includes a medial longitudinal arch support portion, a heel surrounding portion and a lateral longitudinal arch support portion; and a heel portion.

In some embodiments, two of the four resilient layer subsections are constructed of material having different levels of Shore hardness. In some embodiments, at least three of the four resilient layer subsections of the forefoot have a Shore hardness type C scale of 60-70.

In some embodiments, the four resilient layer subsections are of constantly increasing area and correspond to bones of the foot.

In some embodiments, the resilient layer subsections are made of polyvinyl chloride, each of the medial longitudinal arch support and the lateral longitudinal arch support is made from ethylene-vinyl acetate and the metatarsal cushion is made from thermoplastic polyurethane.

In a still further aspect of the invention, a removable insole for insertion into footwear, comprising a forefoot portion integral to the insole and extending at least to a metatarsal of a foot and including a resilient layer, the resilient layer including at least two non-contiguous resilient layer sections, one of the at least two non-contiguous resilient sections including multiple resilient layer subsections; a detachable metatarsal cushion harder than any of the multiple resilient layer subsections and configured to support an anterior transverse arch of a wearer's foot and to redistribute pressure on at least one of a forefoot and mid-foot area of the foot; a continuous rear portion that includes a medial longitudinal arch support portion, a heel surrounding portion and a lateral longitudinal arch support portion, wherein the medial longitudinal arch support portion includes a detachable cushion configured to adjust a height of the medial longitudinal arch and to support the foot during at least one of pronation and eversion of the foot; and a heel portion.

In some embodiments, the insole further comprises a mid-sole cushion integrated with the insole.

In some embodiments, the lateral longitudinal arch support portion includes a detachable cushion for support and redistribution of pressure.

These and other features, aspects and advantages of the present invention will become better understood with reference to the following drawings, descriptions and claims.

BRIEF DESCRIPTION OF THE DRAWINGS

Various embodiments are herein described, by way of example only, with reference to the accompanying drawings, wherein.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The invention generally provides an insole 10 having a base 15. Base 15 may comprises foam or else foam combined with other materials. The forefoot of the insole in some embodiments has several non-contiguous resilient layer sections and at least one of them contains multiple, in some cases four, non-contiguous resilient layer subsections. The insole also comprises a continuous rear portion that includes a medial longitudinal arch support portion, a heel surrounding portion (heel lock) and a lateral longitudinal arch support portion. Typically, the insole 10 also has a heel portion. The non-contiguous subsections may vary in hardness and the set of hardness levels may be set or selected in accordance with which sport the insole is designed to be used for. For example, by varying the hardness of at least one of the subsections of one particular resilient layer section or of at least one of those subsections plus one or more of the remaining resilient layer sections 30*a*, 30*b*, the insole 10, in one version, may be designed for basketball and another version of the insole may be designed for baseball and yet another version of the insole may be designed for simple running.

The principles and operation of an Insole With Customizable Resilient Forefoot Sections and/or Subsections may be better understood with reference to the drawings and the accompanying description.

Figure 1:
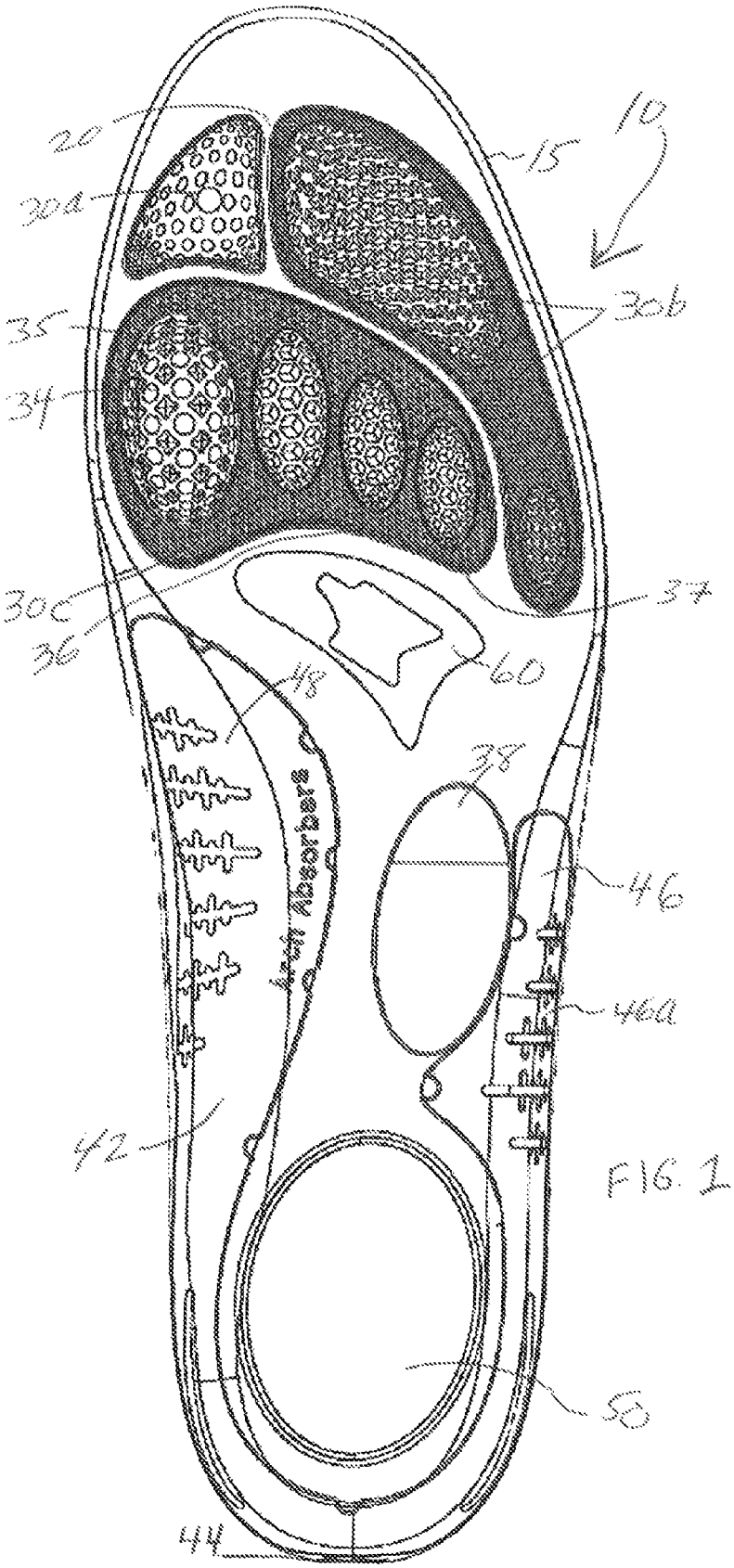
FIG. 1 is a plan view of an insole for footwear for a right foot, in accordance with an embodiment of the invention.
Figure 2:
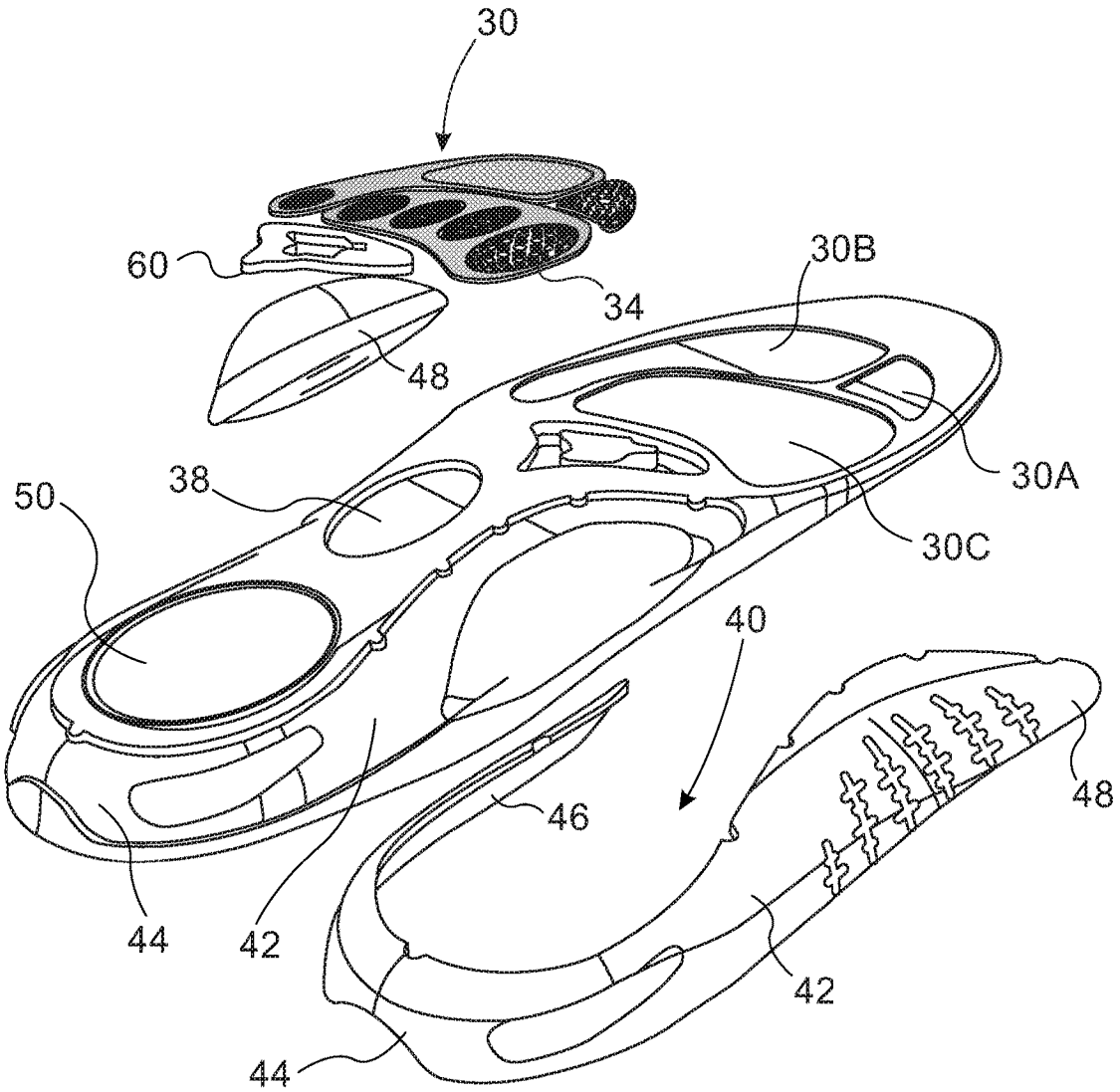
FIG. 2 is an exploded medial view of a right insole without a lateral longitudinal arch support cushion, in accordance with an embodiment of the invention.

As seen from FIG. 1 through FIG. 6, the invention is a removable insole 10 for insertion into footwear and containing a base 15. The base 15 may be made of polyurethane in one non-limiting embodiment. Insole 10 may comprise a forefoot portion 20 integral to the insole 10 and extending at least to a metatarsal of a foot and including a resilient layer 30 (FIG. 2). The resilient layer 30 may include at least two non-contiguous resilient layer sections. For example, in FIG. 1, the resilient layer 30 includes three non-contiguous resilient layer sections 30*a*, 30*b*, 30*c*. The at least two non-contiguous resilient sections include multiple resilient layer subsections, for example at least three or at last four or at least five.

In FIG. 1, a third non-contiguous resilient layer section 30*c* has in some embodiments at least two or at least three, and, in the embodiment shown in FIG. 1, four, resilient layer subsections 34, 35, 36, 37. In one non-limiting example, as seen in FIG. 1, the four resilient layer subsections 34, 35, 36, 37 of resilient layer section 30*c* are of constantly increasing area and correspond to bones of the foot. The resilient layer sections 30*a*, 30*b* and the resilient layer subsections 34, 35, 36, 37 provide shock absorbing properties. The resilient layer subsections 34, 35, 36, 37 are typically also non-contiguous. As seen in FIG. 1, resilient layer subsections 34, 35, 36, 37 may be elliptical.

Resilient layer sections 30*a*, 30*b* together with subsections 34, 35, 36, 37 of resilient layer 30*c* comprise a resilient section of forefoot 20.

The subsections 34, 35, 36, 37 of resilient layer section 30*c* and one or both of the other resilient layer sections 30*a*, 30*b* provide the opportunity to customize the forefoot 20 of the insole 10 in terms of hardness, at least in terms of hardness. Accordingly, for example, the four resilient layer subsections 34, 35, 36, 37, while all resilient, may vary in hardness, (in one non-limiting example as measured by Shore hardness under the Shore type C hardness scale). In some embodiments, each resilient layer subsection (for example subsections 34, 35, 36, 37) of the at least two non-contiguous resilient layer sections has a hardness level that is set (i.e. selected) independently. This is in order to tailor the forefoot 20 to a particular sport to be played by a wearer of the footwear. In some embodiments, the big toe resilient layer section 30*a*, the second resilient layer section 30*b* and the four resilient layer subsections 34, 35, 36, 37 of the third resilient layer section 30*c* comprise a set each of whose elements has a level of hardness (for example a level of hardness of a plastic such as PVC) that is selected (during the manufacturing process) independently in order to tailor the forefoot 20 to a particular sport played by a wearer of the footwear. Accordingly, in some embodiments, each resilient layer subsection of a particular non-contiguous resilient layer section and the two other resilient layer sections (other than the particular resilient layer section) has a hardness level that is selected independently. In one embodiment, the following six portions of the forefoot 20 include the four resilient layer subsections 34, 35, 36, 37 of resilient layer 30*c* and the two resilient layer sections 30*a*, 30*b* other than the particular resilient layer 30*c*. For example, Applicant used a durometer configured for measuring Shore type C hardness of foams, sponges, cushions and/or soft rubbers to measure the six layers on the type C Shore hardness scale and select their level of hardness. In one embodiment, five of the six portions (in other embodiments at least four of the six portions or at least three of the six portions) have a first hardness level of 60-70 (for example 65) and the sixth (in other embodiments two or in other embodiments three) has a second hardness level of 40-60 (for example 45-55 and in one example 50) that is softer than the first hardness level.

All hardness scores referred to herein were obtained by Applicant using a durometer called Japan Teclock model GS-701N Type C (Akser) for low hardness ranges. This durometer complies with JIS K 7312 standard (thermosetting polyurethane elastomer moldings physical test) and is used in the rubber industry to test the hardness of materials such as soft rubber, foam rubber, erasers and windings yarn. This durometer that Applicant used also complies with JIS S 6050 "plastic eraser". Furthermore, this durometer that Applicant used to test the hardness of the resilient section of forefoot 20 has a spring load value of 539-8385 mN (55-855 gf) yielding a result of between 0 and 100. It has a hemispheric indentor having a hemisphere of SR5.08 and an indentor height of 2.54 mm and has a weight of 200 grams. Other durometers may also be used to test the hardness of resilient section of the forefoot 20.

In one embodiment, all of the resilient layer subsections 34, 35, 36, 37 of resilient layer section 30*c* and one or more of the other resilient layer sections 30*a*, 30*b* have a Shore hardness score on a Shore type C scale of about 60-70. In another embodiment, at least one of the six portions of the forefoot (resilient layer subsections 34, 35, 36, 37 of section 30*c* and resilient layer sections 30*a*, 30*b*) have a Shore hardness score on a Shore type C scale of 45-55. In one embodiment, all of the resilient layer subsections 34, 35, 36, 37 and one or more of the other resilient layer sections 30*a*, 30*b* have a Shore hardness on a Shore type C scale of soft or medium soft.

In one embodiment, the at least two non-contiguous resilient layer sections comprise three non-contiguous resilient layer sections 30*a*, 30*b*, 30*c*. For example, as seen in FIG. 1, one of the three non-contiguous resilient layer sections 30*a*, 30*b*, 30*c* comprises four resilient layer subsections 34, 35, 36, 37. Referring again to FIG. 1, in one embodiment, resilient layer section 30*a* (one of the at least two non-contiguous resilient layer sections 30*a*, 30*b*, 30*c* and sometimes called the "big toe section" or the "big toe resilient layer section") of the insole supports a phalanx of a big toe of the foot of the wearer of the insole and is comprised of a first material. In some embodiments, the four resilient layer subsections 34, 35, 36, 37 (or in other embodiments at least three of them or at least two of them or at least one of them) are also comprised of the first material. One non-limiting example of the first material is PVC.

In some embodiments, one of the at least four resilient layer subsections within a particular non-contiguous resilient layer section comprises a first level of hardness and another one of the at least four resilient layer subsections within the particular non-contiguous resilient layer section comprises a second level of hardness that is softer than the first level of hardness. In one non-limiting example, the above hardness is measured by Shore hardness under Shore type C scale hardness. In some embodiments, at least two of four resilient layer subsections within a particular non-contiguous resilient layer section have different levels of hardness. In one embodiment, the four resilient layer subsections 34, 35, 36, 37 are of constantly increasing surface area and correspond to bones of the foot. For example, as can be seen from FIG. 1, the surface area of subsection 34 exceeds the surface area of subsection 35 and the surface area of subsection 35 exceeds the surface area of subsection 36 and the surface area of subsection 36 exceeds that of subsection 37.

Figure 3:
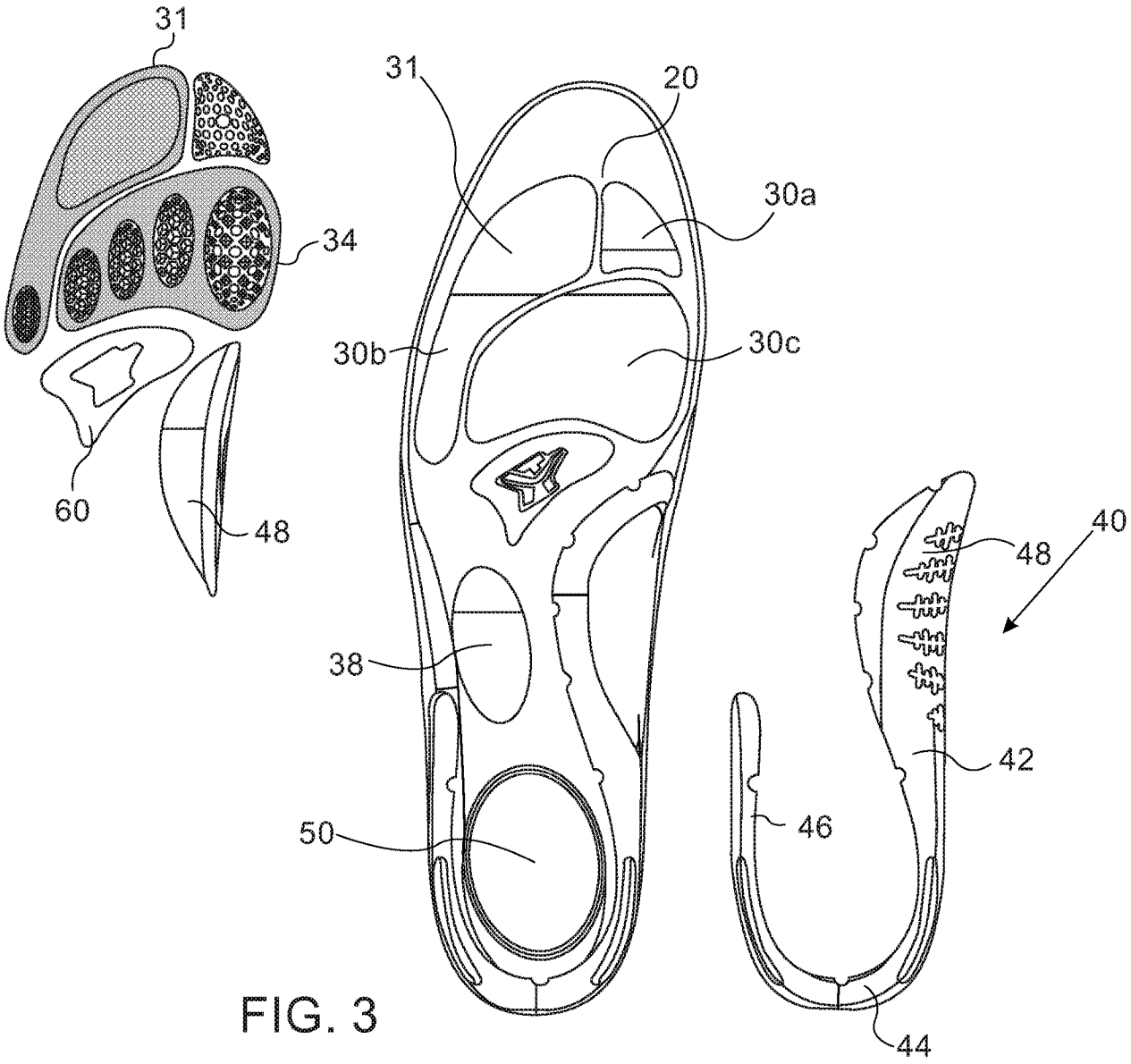
FIG. 3 is an exploded plan view of a right insole without a lateral longitudinal arch support cushion, in accordance with an embodiment of the invention.

Referring further to FIG. 2 and FIG. 3, insole 10 also comprises a continuous rear portion 40 that includes three parts: a medial longitudinal arch support portion 42, a heel lock 44—also called a heel-surrounding portion 44 and a lateral longitudinal arch support portion 46. Insole 10 may also include a heel portion 50. The heel surrounding portion 44 connects the medial longitudinal arch support portion 42 with the lateral longitudinal arch support portion 46 and wraps around the heel of the footwear.

Figure 4:
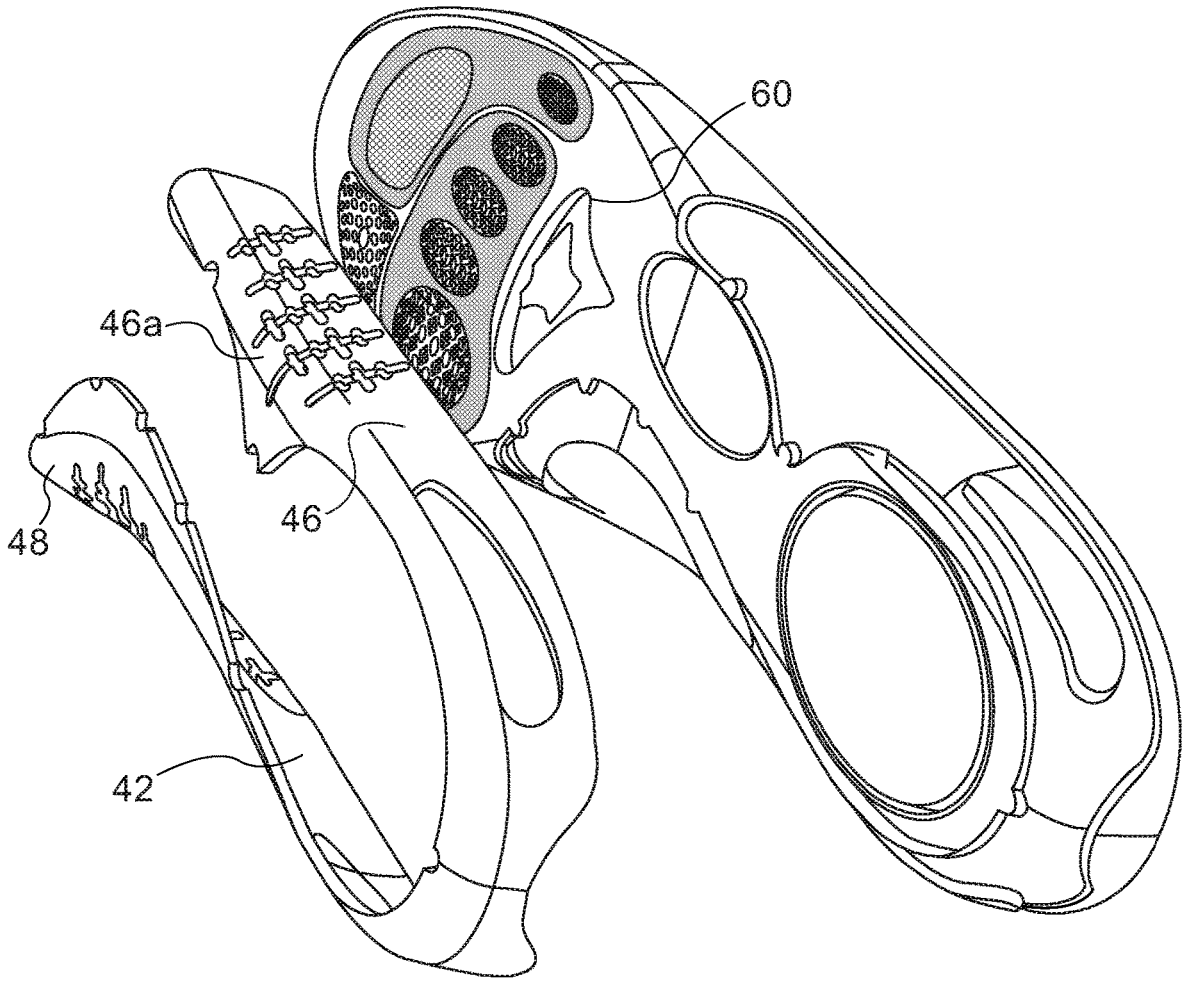
FIG. 4 is an exploded lateral view of a left insole in accordance with an embodiment of the invention.
Figure 5:
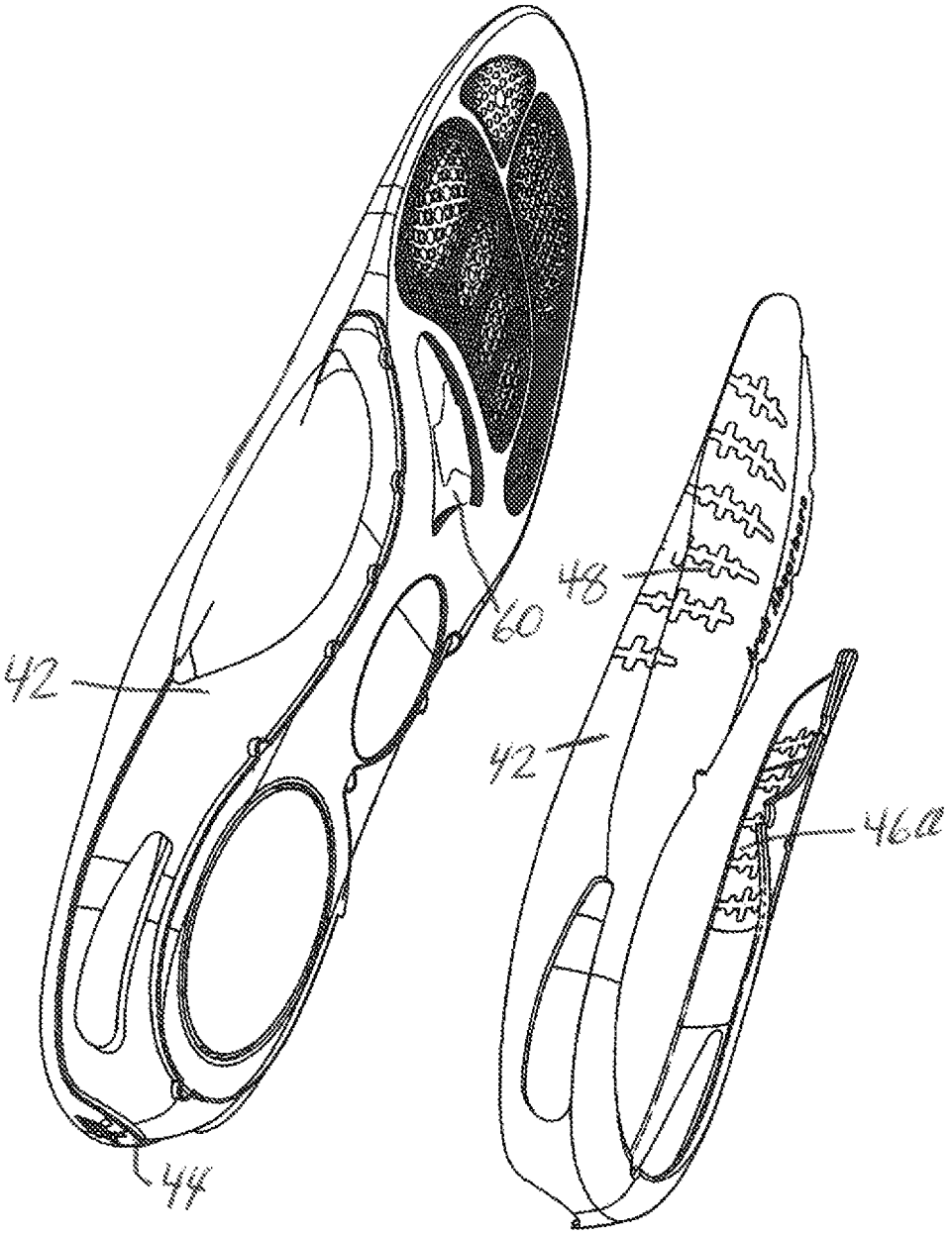
FIG. 5 is an exploded medial view of a left insole from the medial.
Figure 6:
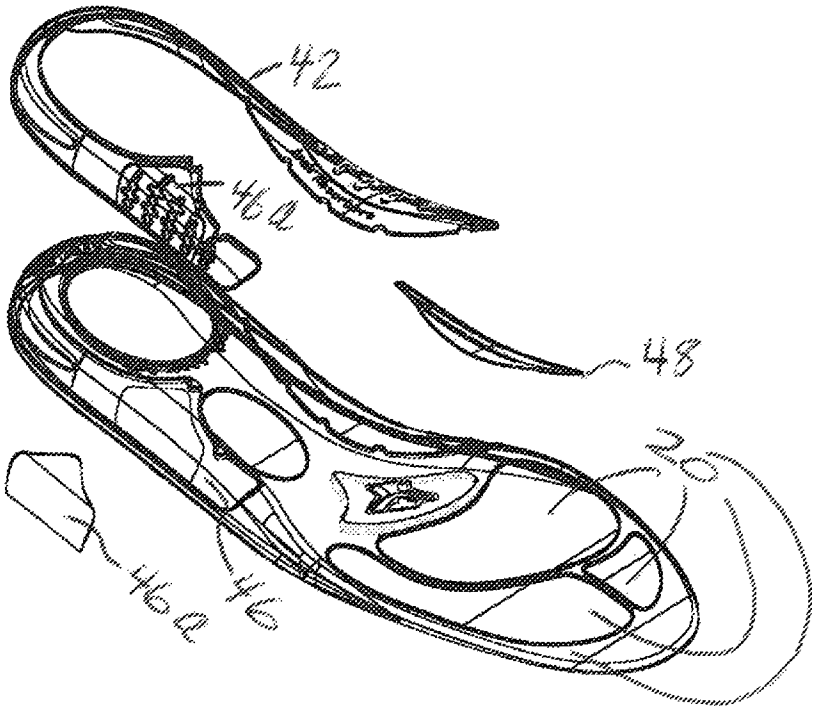
FIG. 6 is a top perspective view of a left insole showing the detachable cushion in exploded form in accordance with an embodiment of the invention.

As seen in FIG. 2, FIG. 3 and FIG. 6, the medial longitudinal arch support portion 42 includes a detachable cushion 48, the detachable cushion 48 configured to adjust a height of a medial longitudinal arch of the foot and to support the foot during pronation. As seen from FIG. 4, FIG. 5 and FIG. 6, the lateral longitudinal arch support portion 46 includes a detachable cushion 46*a* configured to support the lateral longitudinal arch of the foot and to redistribute pressure to avoid hairline and fifth metatarsal fractures. Note that FIG. 6 shows the cushion 46*a* itself and FIGS. 4-5 show the location of the cushion 46*a*.

Insole 10 may also include detachable metatarsal cushion 60 configured to support an anterior transverse arch of a wearer's foot and to redistribute pressure on at least one of a forefoot and mid-foot area of the foot. The metatarsal cushion 60 is in some embodiments harder than the resilient layer subsections—for example harder than each of subsections 34, 35, 36, 37—and in some embodiments harder than each of subsections 34, 35, 36, 37 and big toe section 30*a*—and in some embodiments harder than any of the resilient layer sections 30*a*, 30*b*, 30*c* and in some embodiments harder than the base 15.

In another embodiment, the invention is an insole 10 for insertion into footwear, comprising a forefoot portion integral to the insole and extending at least to a metatarsal of a foot and including a resilient layer, the resilient layer including at least two non-contiguous resilient layer sections, one of the at least two non-contiguous resilient sections including four separate non-contiguous resilient layer subsections, a continuous rear portion that includes a medial longitudinal arch support portion 42, a heel lock (heel surrounding portion) 44 and a lateral longitudinal arch support portion 46; and a heel portion 50.

In some embodiments, two of the four resilient layer subsections 34, 35, 36, 37 are constructed of material having different levels of hardness (for example as measured by Shore hardness type C scale). The examples given for previous embodiments apply here as well. In one embodiment, the four resilient layer subsections 34, 35, 36, 37 are of constantly increasing surface area and correspond to bones of the foot. For example the surface area of subsection 34 exceeds the surface area of subsection 35 and the surface area of subsection 35 exceeds the surface area of subsection 36 and the surface area of subsection 36 exceeds that of subsection 37. In one embodiment, the resilient layer subsections 34, 35, 36, 37 of resilient layer section 30*c* and the big toe resilient layer section 30*a* (or both sections 30*a*, 30*b*) are each made of polyvinyl chloride. In some embodiments, the medial longitudinal arch support and the lateral longitudinal arch support are each made from ethylene-vinyl acetate (EVA) and the metatarsal cushion is made from thermoplastic polyurethane.

In one version, out of the following six portions of the forefoot 20 include the four resilient layer subsections 34, 35, 36, 37 of resilient layer 30*c* and the two resilient layer sections 30*a*, 30*b* other than the particular resilient layer 30*c*, five of the six portions have a first hardness level of 65 and the sixth has a second hardness level of 50 that is softer than the first hardness level. In one embodiment, all of the resilient layer subsections 34, 35, 36, 37 of resilient layer section 30*c* and one or more of the other resilient layer sections 30*a*, 30*b* have a Shore hardness on a Shore type C scale of about 60-70 for example 65. In another embodiment, at least one of the six portions of the forefoot (resilient layer subsections 34, 35, 36, 37 of section 30*c* and resilient layer sections 30*a*, 30*b*) have a Shore hardness on a type C scale of 40-60, for example 45-55, in one example 50.

A further embodiment of the invention is a removable insole for insertion into footwear, comprising a forefoot portion integral to the insole and extending at least to a metatarsal of a foot and including a resilient layer, the resilient layer including at least two non-contiguous resilient layer sections, one of the at least two non-contiguous resilient sections including multiple resilient layer subsections; a detachable metatarsal cushion harder than any of the multiple resilient layer subsections and configured to support an anterior transverse arch of a wearer's foot and to redistribute pressure on at least one of a forefoot and mid-foot area of the foot. The insole 10 also includes a continuous rear portion 40 that includes a medial longitudinal arch support portion 42, a heel surrounding portion (heel lock 44) and a lateral longitudinal arch support portion 46, wherein the medial longitudinal arch support portion 42 includes a detachable cushion 48 configured to adjust a height of the medial longitudinal arch and to support the foot during at least one of pronation and eversion of the foot (note that eversion is a component of pronation). Insole 10 also includes a heel portion 50.

In any embodiment, the insole may include a mid-sole cushion 38 integrated with the insole 10.

The lateral longitudinal arch support portion may include a detachable cushion for support and redistribution of pressure.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A removable insole for insertion into footwear, comprising:

a forefoot portion integral to the insole and extending at least to an area configured to be placed against a metatarsal of a foot and including a resilient layer, the resilient layer including at least two non-contiguous resilient layer sections, the at least two non-contiguous resilient sections including four resilient layer subsections, at least two of the multiple resilient layer subsections having an elliptical shape, a first of the multiple resilient layer subsections having a first Shore hardness level of between 40 to 70 measured on a type C Shore hardness scale and configured to be tailored to a first sport to be played by a wearer of the footwear and a second of the multiple resilient layer subsections having a second Shore hardness level of 40 to 70 measured on a type C Shore hardness scale and configured to be tailored to a second sport to be played by the wearer, a continuous rear portion that includes a medial longitudinal arch support portion, a heel surrounding portion and a lateral longitudinal arch support portion; and a heel portion, wherein the lateral longitudinal arch support portion includes a detachable cushion configured to support the lateral longitudinal arch of the foot and to redistribute pressure to avoid hairline and fifth metatarsal fractures.

2. The insole of claim 1, wherein the at least two non-contiguous resilient layer sections comprise three non-contiguous resilient layer sections.

3. The insole of claim 1, wherein one of the at least two non-contiguous resilient layer sections corresponds to a portion of the insole configured to support a phalanx of a big toe of the foot and is comprised of a first material and the at least four resilient layer subsections are comprised of the first material.

4. The insole of claim 1, wherein one of the at least four resilient layer subsections within a particular non-contiguous resilient layer section comprises a first level of hardness and another one of the at least four resilient layer subsections within the particular non-contiguous resilient layer section comprises a second level of hardness that is softer than the first level of hardness.

5. The insole of claim 1, wherein at least two of four resilient layer subsections within a particular non-contiguous resilient layer section have different levels of hardness.

6. The insole of claim 1, wherein each of the first sport and the second sport is from among basketball, baseball and running.

7. The insole of claim 1, wherein of the following six portions of the forefoot: the four resilient layer subsections and the two resilient layer sections other than the particular resilient layer, five of the six portions of the forefoot have a first hardness level and a sixth has a second hardness level that is softer than the first hardness level.

8. The insole of claim 1, further comprising a detachable metatarsal cushion configured to support an anterior transverse arch of a wearer's foot and to redistribute pressure on at least one of a forefoot and mid-foot area of the foot.

9. The insole of claim 8, wherein the metatarsal cushion is harder than the resilient layer subsections.

10. The insole of claim 1, wherein the medial longitudinal arch support portion includes an integral resilient layer and a detachable cushion, the detachable cushion configured to adjust a height of a medial longitudinal arch of the foot and to support the foot during pronation.

11. A removable insole for insertion into footwear, comprising:

a forefoot portion integral to the insole and extending at least to an area configured to be placed against a metatarsal of a foot and including a resilient layer, the resilient layer including at least two non-contiguous resilient layer sections, one of the at least two non-contiguous resilient sections including four separate non-contiguous resilient layer subsections, at least three of the multiple resilient layer subsections having an elliptical shape, a first of the multiple resilient layer subsections configured to be tailored to a first sport from among basketball, baseball and running to be played by a wearer of the footwear and a second of the multiple resilient layer subsections configured to be tailored to a second sport from among basketball, baseball and running to be played by the wearer, wherein a hardness of the first of the multiple resilient layer subsections differs from a hardness of the second of the multiple resilient layer sections, a continuous rear portion that includes a medial longitudinal arch support portion, a heel surrounding portion and a lateral longitudinal arch support portion; and a heel portion, wherein when measuring surface areas of resilient layer subsections of the insole, the insole configured for footwear for a right foot, in a direction from a portion of the insole configured for an inside of the right foot to a portion of the insole configured for an outside of the right foot, a measured surface area of each of the four resilient layer subsections constantly decreases.

12. The insole of claim 11, wherein at least three of the four resilient layer subsections of the forefoot have a Shore hardness type C scale of 60-70.

13. The insole of claim 10, wherein the four resilient layer subsections are configured to correspond in area to bones of the foot.

14. The insole of claim 10, wherein the resilient layer subsections are made of polyvinyl chloride, each of the medial longitudinal arch support and the lateral longitudinal arch support is made from ethylene-vinyl acetate and a metatarsal cushion is made from thermoplastic polyurethane.

* * * * *